US008771032B2

(12) United States Patent
Chang et al.

(10) Patent No.: US 8,771,032 B2
(45) Date of Patent: Jul. 8, 2014

(54) BLOCK ASSEMBLY

(75) Inventors: Ju-Yi Chang, Tainan (TW); Feng-Jun Lo, Tainan (TW); Yung-Teng Lo, Tainan (TW)

(73) Assignee: Delsun Co., Ltd., Tainan (TW)

( * ) Notice: Subject to any disclaimer, the term of this patent is extended or adjusted under 35 U.S.C. 154(b) by 202 days.

(21) Appl. No.: 13/427,962

(22) Filed: Mar. 23, 2012

(65) Prior Publication Data

US 2013/0252504 A1 Sep. 26, 2013

(51) Int. Cl.
*A63H 33/08* (2006.01)

(52) U.S. Cl.
USPC ..... 446/124

(58) Field of Classification Search
USPC ..... 446/115, 116, 117, 120, 121, 124, 125, 446/128
See application file for complete search history.

(56) References Cited

U.S. PATENT DOCUMENTS 3,405,479 A * 10/1968 Paulson ..... 446/128
4,744,780 A * 5/1988 Volpe ..... 446/128
4,883,440 A * 11/1989 Bolli ..... 446/91
5,471,808 A * 12/1995 De Pieri et al. ..... 52/603
D377,671 S * 1/1997 Gabriel ..... D21/500
5,795,210 A * 8/1998 Kushner et al. ..... 446/128
6,050,044 A * 4/2000 McIntosh ..... 52/591.1
6,554,676 B1 * 4/2003 Bach ..... 446/116
6,648,715 B2 * 11/2003 Wiens et al. ..... 446/121
6,682,385 B2 * 1/2004 Atzen et al. ..... 446/124
7,267,598 B2 * 9/2007 Glickman ..... 446/124
D616,046 S * 5/2010 Hwang ..... D21/501
8,105,128 B1 * 1/2012 Sorensen et al. ..... 446/128
2012/0071061 A1 * 3/2012 Smith et al. ..... 446/128
2013/0252503 A1 * 9/2013 Kwok et al. ..... 446/102

* cited by examiner

*Primary Examiner* — Kurt Fernstrom
(74) *Attorney, Agent, or Firm* — Alan Kamrath; Kamrath IP Lawfirm, P.A.

(57) ABSTRACT

A block assembly includes at least two blocks detachably connected with each other. Each of the blocks includes a main body having a bottom provided with a receiving space, at least one connecting knob formed on a top of the main body, a plurality of positioning rails formed on a peripheral wall of the receiving space, and at least one positioning piece located in the receiving space. The positioning piece has a periphery provided with at least four arcuate positioning faces. Thus, when the connecting knob of the first one of the blocks is inserted between the positioning piece and the positioning rails of the second one of the blocks, one of the positioning faces of the positioning piece covers and presses the periphery of the connecting knob of the first one of the blocks.

3 Claims, 7 Drawing Sheets

BLOCK ASSEMBLY

BACKGROUND OF THE INVENTION

1. Field of the Invention

The present invention relates to a toy and, more particularly, to a block (or building block) assembly.

2. Description of the Related Art

A conventional block assembly in accordance with the prior art shown in FIG. 1 comprises at least two blocks 1 detachably connected with each other. Each of the blocks 1 includes a box-shaped main body 11 having a bottom provided with a receiving space 13, at least one connecting knob 12 formed on a top of the main body 11, a plurality of positioning rails 15 formed on a peripheral wall of the receiving space 13 of the main body 11, and at least one positioning piece 14 located in the receiving space 13 of the main body 11. Thus, when the blocks 1 are connected, the connecting knob 12 of a first one of the blocks 1 is inserted into the receiving space 13 of the main body 11 of a second one of the blocks 1, and is clamped between the positioning piece 14 and at least one of the positioning rails 15 of the second one of the blocks 1. However, the connecting knob 12 of the first one of the blocks 1 and the positioning piece 14 of the second one of the blocks 1 are connected by a point-to-point connection so that the connecting knob 12 of the first one of the blocks 1 is easily loosened from the positioning piece 14 of the second one of the blocks 1, and the blocks 1 are easily detached from each other.

BRIEF SUMMARY OF THE INVENTION

In accordance with the present invention, there is provided a block assembly, comprising at least two blocks detachably connected with each other. Each of the blocks includes a box-shaped main body having a bottom provided with a receiving space, at least one connecting knob formed on a top of the main body, a plurality of positioning rails formed on a peripheral wall of the receiving space of the main body, and at least one positioning piece located in the receiving space of the main body. The positioning piece of each of the blocks has a periphery provided with at least four positioning faces each of which has a substantially arcuate shape. Thus, when the blocks are connected, the connecting knob of a first one of the blocks is inserted into the receiving space of the main body of a second one of the blocks, and is clamped between the positioning piece and at least one of the positioning rails of the second one of the blocks. The connecting knob of the first one of the blocks has a periphery abutting one of the positioning faces of the positioning piece of the second one of the blocks exactly and closely.

Each of the blocks further includes at least one limit member located in the receiving space of the main body. The limit member is disposed between the positioning piece and at least one of the positioning rails. Thus, when the blocks are connected, the connecting knob of the first one of the blocks has a top abutting the limit member of the second one of the blocks.

The connecting knob of each of the blocks has a top face provided with a chamfered portion. Each of the positioning rails of each of the blocks has a bottom provided with a chamfered portion, and each of the positioning faces of the positioning piece of each of the blocks has a bottom provided with a chamfered portion.

The primary objective of the present invention is to provide a block assembly that is assembled closely and tightly.

According to the primary advantage of the present invention, when the connecting knob of the first one of the blocks is inserted between the positioning piece and the positioning rails of the second one of the blocks, one of the positioning faces of the positioning piece covers and presses the periphery of the connecting knob of the first one of the blocks so that the connecting knob of the first one of the blocks is clamped between the positioning piece and the positioning rails of the second one of the blocks exactly and closely.

According to another advantage of the present invention, the connecting knob of the first one of the blocks abuts the limit member of the second one of the blocks so that the blocks are combined solidly and stably.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
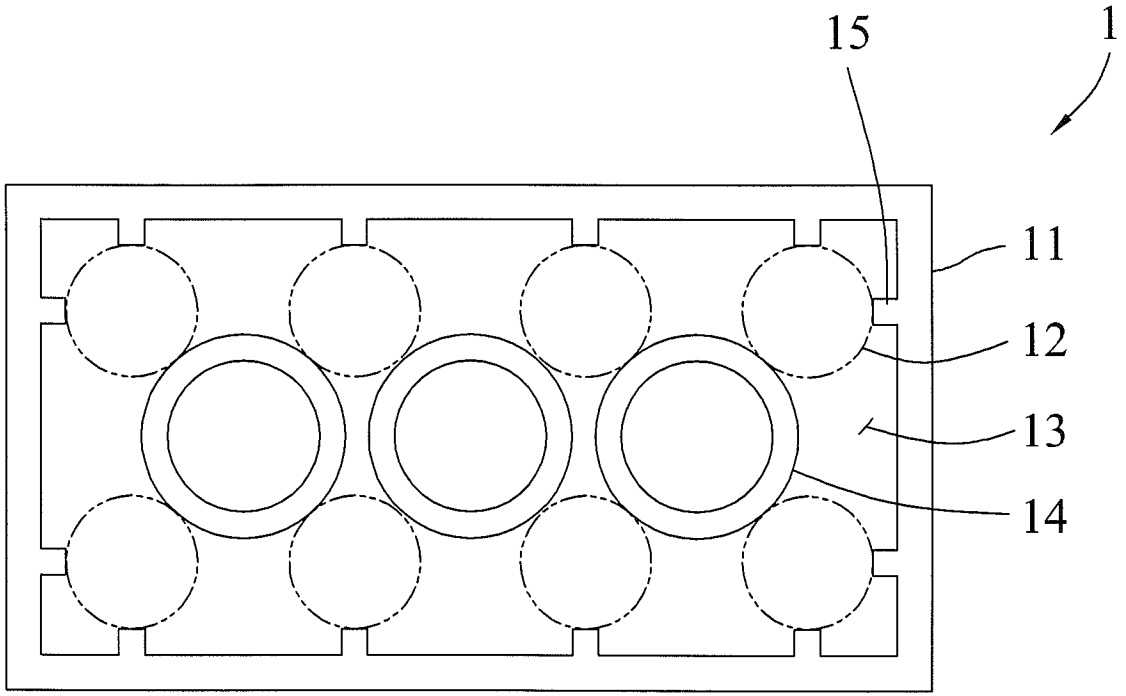
FIG. 1 PRIOR ART
FIG. 1 is a bottom view of a conventional block assembly in accordance with the prior art.
Figure 2:
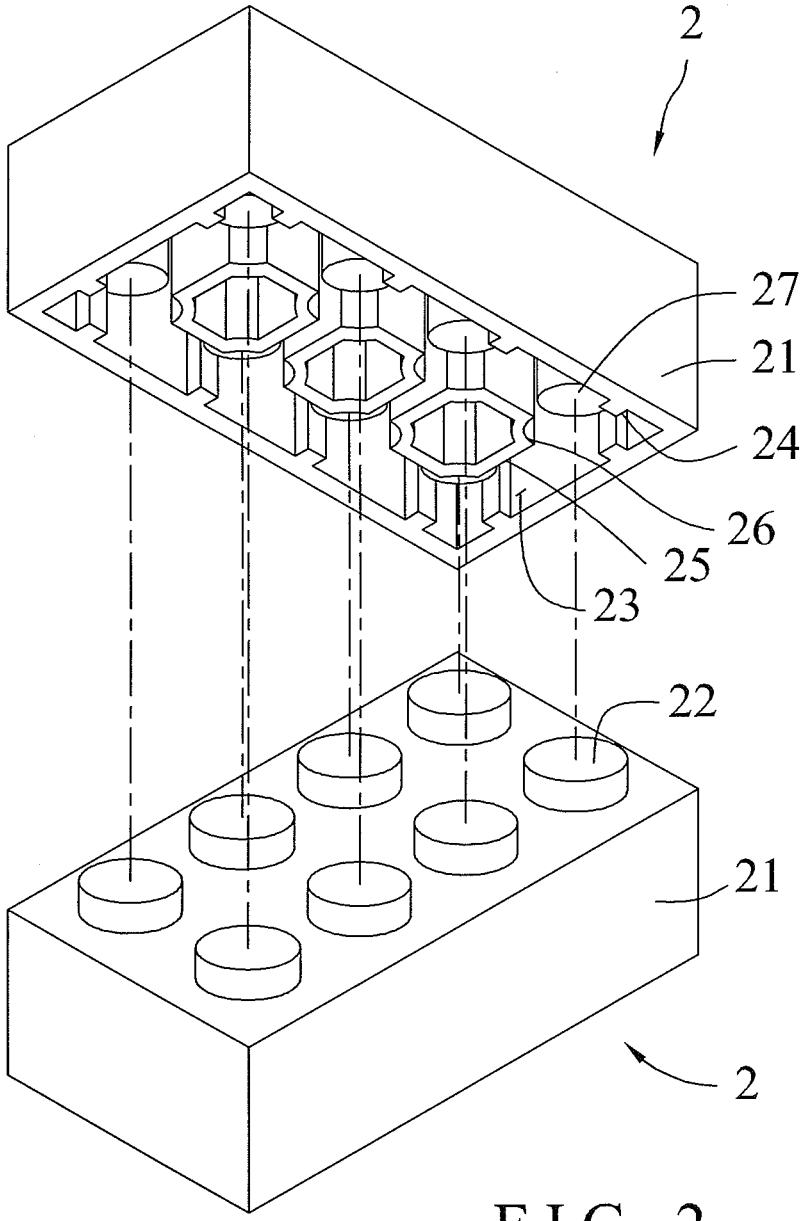
FIG. 2 is an exploded perspective view of a block assembly in accordance with the preferred embodiment of the present invention.
Figure 3:
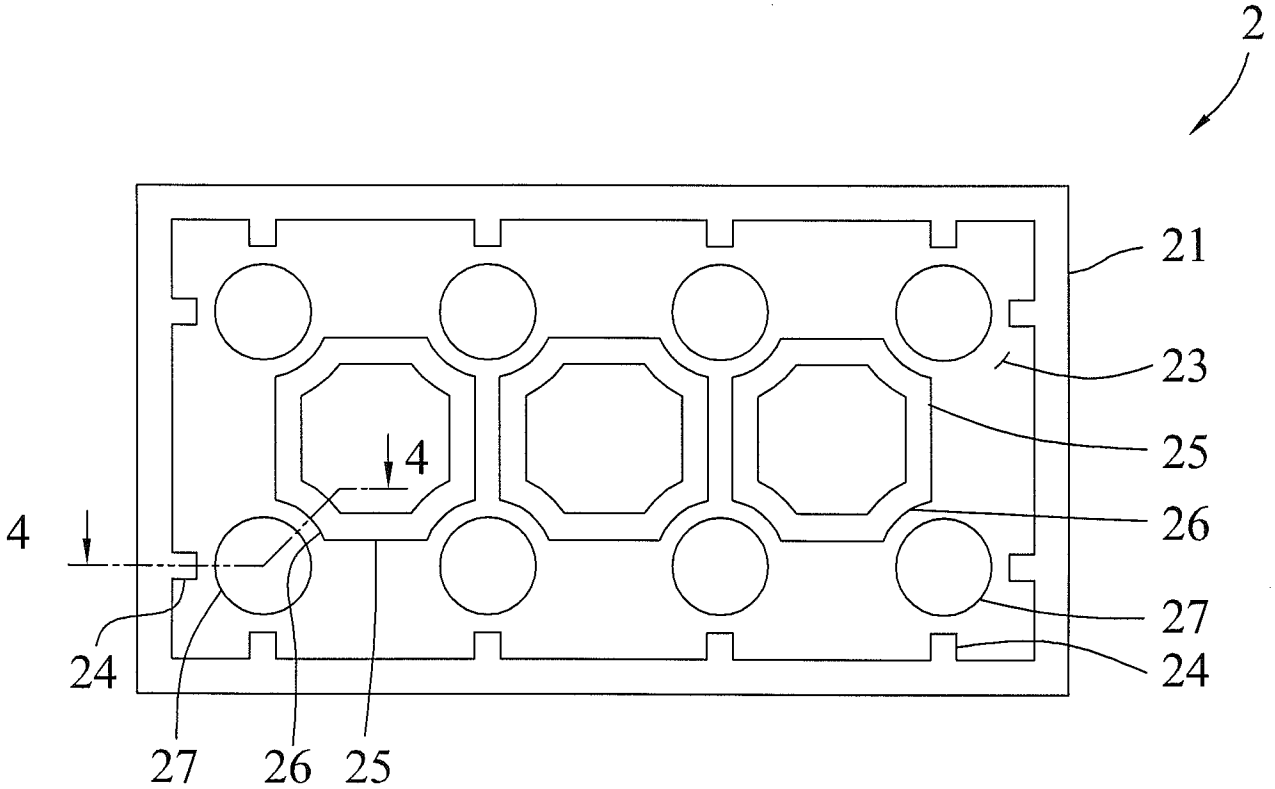
FIG. 3 is a bottom view of the block assembly as shown in FIG. 2.
Figure 4:
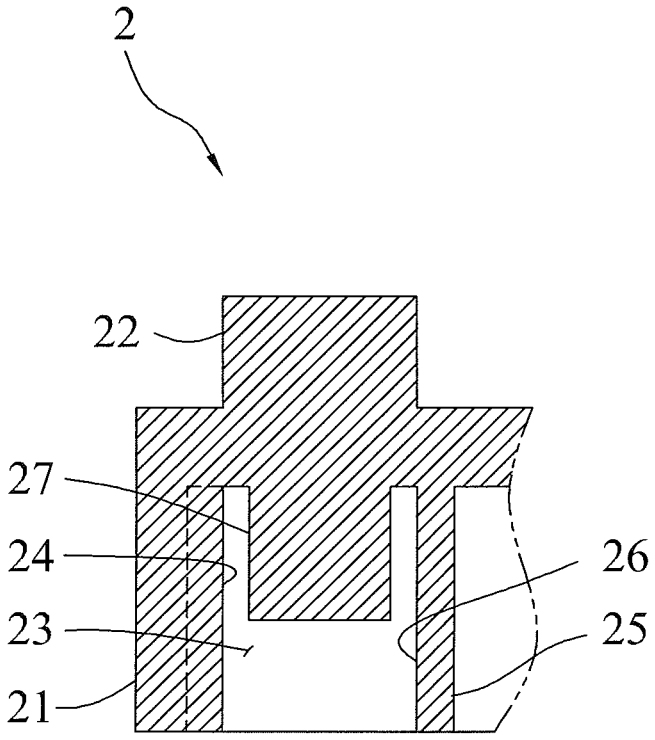
FIG. 4 is a cross-sectional view of the block assembly taken along line 4-4 as shown in FIG. 3.
Figure 5:
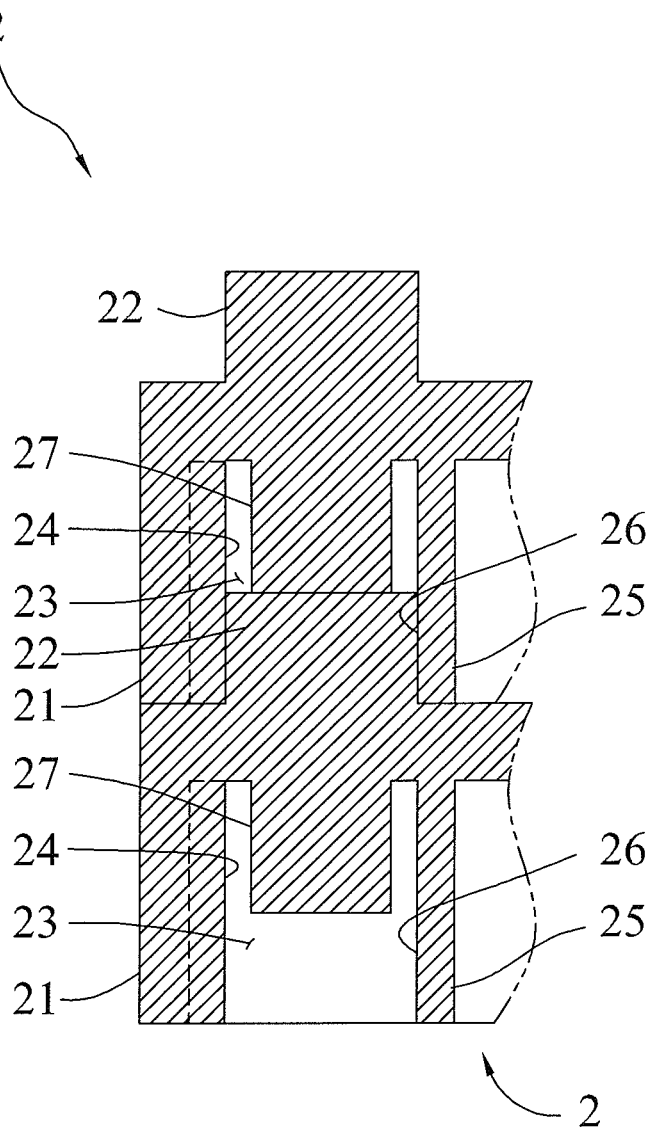
FIG. 5 is a side cross-sectional assembly view of the block assembly as shown in FIG. 2.

Referring to the drawings and initially to FIGS. 2-5, a block assembly in accordance with the preferred embodiment of the present invention comprises at least two blocks 2 detachably connected with each other.

Each of the blocks 2 includes a box-shaped main body 21 having a bottom provided with a receiving space 23, at least one connecting knob 22 formed on a top of the main body 21, a plurality of positioning rails 24 formed on a peripheral wall of the receiving space 23 of the main body 21, and at least one positioning piece 25 located in the receiving space 23 of the main body 21.

The connecting knob 22 of each of the blocks 2 has a circular shape. The positioning piece 25 of each of the blocks 2 has a substantially square shape and has a periphery provided with at least four positioning faces 26 each of which has a substantially arcuate shape. Thus, when the blocks 2 are connected, the connecting knob 22 of a first one of the blocks 2 is inserted into the receiving space 23 of the main body 21 of a second one of the blocks 2, and is clamped between the positioning piece 25 and at least one of the positioning rails 24 of the second one of the blocks 2. The connecting knob 22 of the first one of the blocks 2 has a periphery abutting one of the positioning faces 26 of the positioning piece 25 of the second one of the blocks 2 exactly and closely.

In such a manner, the connecting knob 22 of the first one of the blocks 2 and one of the positioning faces 26 of the positioning piece 25 of the second one of the blocks 2 are connected by a plane-to-plane connection so that the connecting knob 22 of the first one of the blocks 2 and the positioning piece 25 of the second one of the blocks 2 are connected closely and tightly.

Each of the blocks 2 further includes at least one limit member 27 located in the receiving space 23 of the main body 21. The limit member 27 is disposed between the positioning piece 25 and at least one of the positioning rails 24. The limit member 27 has a circular shape and has a length smaller than that of the positioning piece 25 and smaller than that of each of the positioning rails 24. Thus, when the blocks 2 are connected, the connecting knob 22 of the first one of the blocks 2 has a top abutting the limit member 27 of the second one of the blocks 2.

In the preferred embodiment of the present invention, each of the blocks 2 has a substantially rectangular shape and includes eight connecting knobs 22, three positioning pieces 25 and eight limit members 27.

In assembly, when each of the connecting knobs 22 of the first one of the blocks 2 is inserted into the receiving space 23 of the main body 21 of the second one of the blocks 2, each of the connecting knobs 22 of the first one of the blocks 2 is clamped between at least one of the positioning faces 26 of a respective one of the positioning pieces 25 and at least one of the positioning rails 24 of the second one of the blocks 2. At this time, the periphery of each of the connecting knobs 22 of the first one of the blocks 2 is covered and pressed by at least one of the positioning faces 26 of the respective positioning piece 25 so that each of the connecting knobs 22 of the first one of the blocks 2 is clamped between the respective positioning piece 25 and the positioning rails 24 of the second one of the blocks 2 exactly and closely. In addition, each of the connecting knobs 22 of the first one of the blocks 2 abuts a respective one of the limit members 27 of the second one of the blocks 2 so that the blocks 2 are combined solidly and stably.

Figure 6:
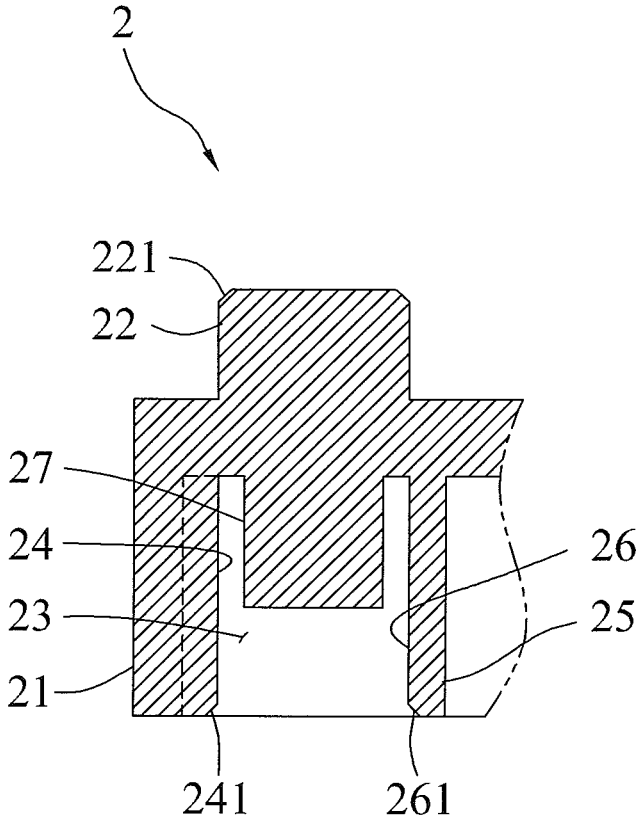
FIG. 6 is a partially cross-sectional view of a block assembly in accordance with another preferred embodiment of the present invention.

As shown in FIG. 6, the connecting knob 22 of each of the blocks 2 has a top face provided with a chamfered portion 221, each of the positioning rails 24 of each of the blocks 2 has a bottom provided with a chamfered portion 241, and each of the positioning faces 26 of the positioning piece 25 of each of the blocks 2 has a bottom provided with a chamfered portion 261. Thus, the connecting knob 22 of the first one of the blocks 2 is inserted between the positioning piece 25 and the positioning rails 24 of the second one of the blocks 2 easily and smoothly by guidance of the chamfered portion 221 of the connecting knob 22, the chamfered portion 241 of each of the positioning rails 24 and the chamfered portion 261 of each of the positioning faces 26 of the positioning piece 25. In addition, the chamfered portion 221 of the connecting knob 22 of each of the blocks 2 prevents the connecting knob 22 of each of the blocks 2 from scratching or hurting the user, thereby protecting the user's safety when playing the blocks 2.

Figure 7:
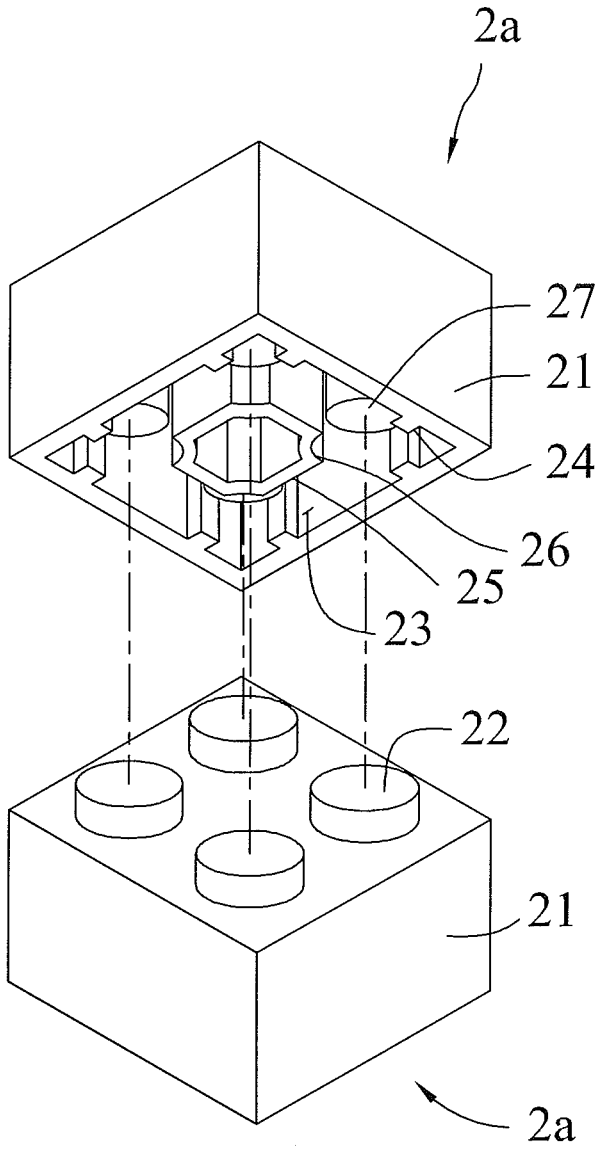
FIG. 7 is an exploded perspective view of a block assembly in accordance with another preferred embodiment of the present invention.

As shown in FIG. 7, each of the blocks 2*a* has a substantially square shape and includes four connecting knobs 22, one positioning piece 25 and four limit members 27.

Accordingly, when the connecting knob 22 of the first one of the blocks 2 is inserted between the positioning piece 25 and the positioning rails 24 of the second one of the blocks 2, one of the positioning faces 26 of the positioning piece 25 covers and presses the periphery of the connecting knob 22 of the first one of the blocks so that the connecting knob 22 of the first one of the blocks 2 is clamped between the positioning piece 25 and the positioning rails 24 of the second one of the blocks 2 exactly and closely. In addition, the connecting knob 22 of the first one of the blocks 2 abuts the limit member 27 of the second one of the blocks 2 so that the blocks 2 are combined solidly and stably.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A block assembly comprising:

at least two blocks detachably connected with each other; wherein:

each of the blocks includes:

a box-shaped main body having a bottom provided with a receiving space;

at least one connecting knob formed on a top of the main body;

a plurality of positioning rails formed on a peripheral wall of the receiving space of the main body; and at least one positioning piece located in the receiving space of the main body;

the positioning piece of each of the at least two blocks has a periphery provided with at least four positioning faces each of which has a substantially arcuate shape;

when the blocks are connected, the connecting knob of a first one of the at least two blocks is inserted into the receiving space of the main body of a second one of the at least two blocks, and is clamped between the positioning piece and at least one of the positioning rails of the second one of the at least two blocks;

the connecting knob of the first one of the blocks has a periphery abutting one of the positioning faces of the positioning piece of the second one of the at least two blocks exactly and closely;

the connecting knob of each of the at least two blocks has a top face provided with a chamfered portion;

each of the positioning rails of each of the at least two blocks has a bottom provided with a chamfered portion; and each of the positioning faces of the positioning piece of each of the at least two blocks has a bottom provided with a chamfered portion.

2. The block assembly of claim 1, wherein each of the at least two blocks further includes at least one limit member located in the receiving space of the main body.

3. The block assembly of claim 2, wherein:

the limit member is disposed between the positioning piece and at least one of the positioning rails; and when the at least two blocks are connected, the connecting knob of the first one of the at least two blocks has a top abutting the limit member of the second one of the at least two blocks.

* * * * *